United States Patent [19]

Burrows et al.

[11] 4,071,212

[45] Jan. 31, 1978

[54] IMPLEMENT RACK

[75] Inventors: Thomas M. Burrows, Barrington; Harold P. Ashton, Providence, both of R.I.

[73] Assignee: Imperial Knife Associated Companies, Inc., Providence, R.I.

[21] Appl. No.: 766,060

[22] Filed: Feb. 7, 1977

[51] Int. Cl.[2] ..... A47G 21/14

[52] U.S. Cl. ..... 248/37.6; 211/60 T

[58] Field of Search ..... 248/37.6, 37.3; 211/60 A, 60 T, 60 R, 60 SK, 60 A, 60 M, 68

[56] References Cited

U.S. PATENT DOCUMENTS

| | | | |
|---|---|---|---|
| D. 165,894 | 2/1952 | Adler | 248/37.6 |
| 2,183,074 | 12/1939 | Hopkins | 248/37.6 |
| 2,338,303 | 1/1944 | Rosenberg | 248/37.6 |
| 2,754,008 | 7/1956 | Culver | 248/37.6 |
| 2,919,032 | 12/1959 | Sinawski | 211/60 SK |
| 3,580,394 | 5/1971 | Elliot | 248/37.6 |

*Primary Examiner*—Roy D. Frazier
*Assistant Examiner*—Rodney H. Bonck
*Attorney, Agent, or Firm*—Kirschstein, Kirschstein, Ottinger, Frank & Cobrin

[57] ABSTRACT

An implement rack having upper and lower slotted members mounted on a support. The slots are so shaped and disposed as to receive, from the front of the rack, knife blades at off-vertical angles, the knives then resting on the upper member at the bases of their handles and swinging toward vertical positions. Tongues between the members prevent the blades from being withdrawn forwardly from the rack in their vertical or more nearly vertical positions. Such operation of the rack is predicated upon the utilization of knives having their centers of gravity in the blades. The rack also can be used for culinary utensils. The invention further encompasses a unique method of inserting such knives and implements into the rack, of retaining the knives within the rack in a manner which reduces the likelihood of accidental release, and of permitting convenient removal of the knives from the rack. This invention is intended for use as a fixture to be affixed to a vertical surface.

10 Claims, 9 Drawing Figures

FIG. 6
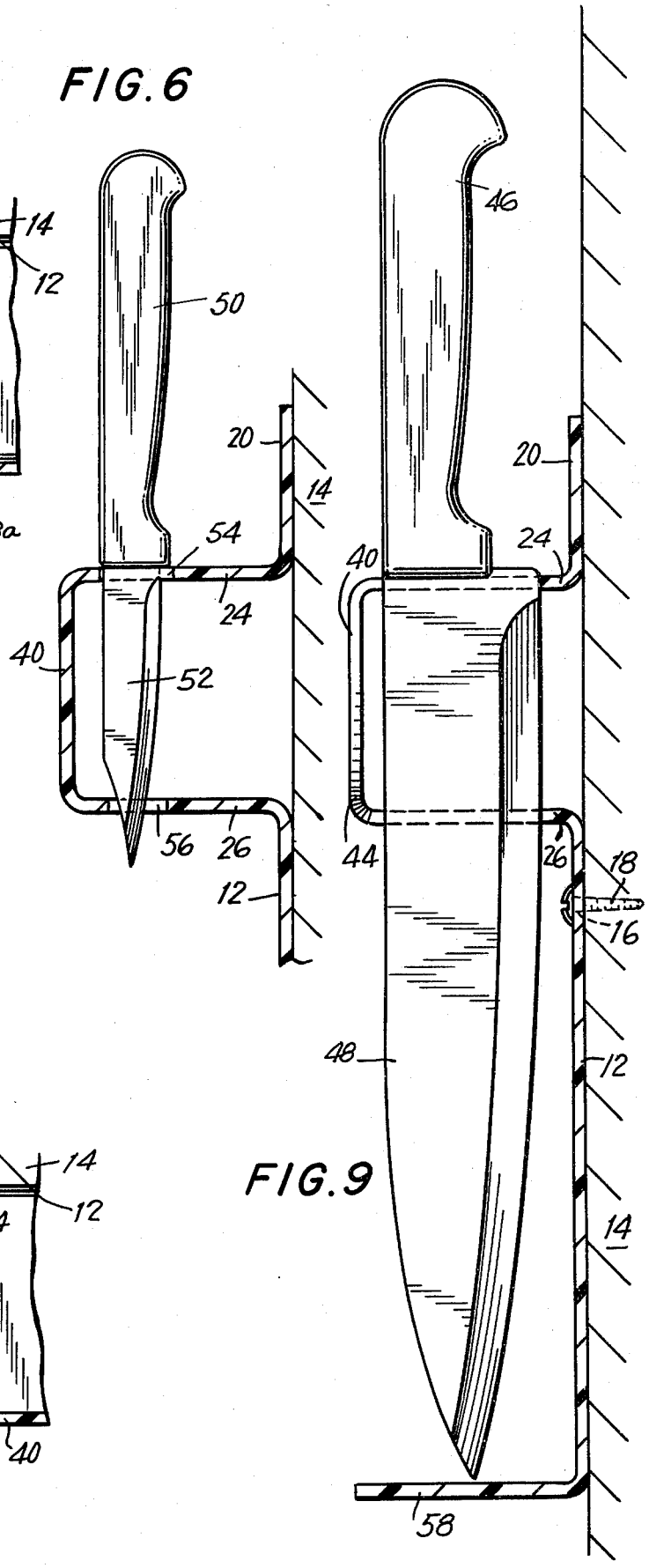
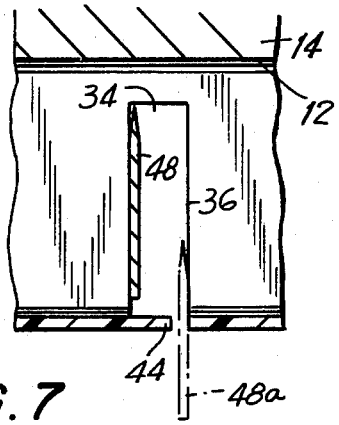
FIG. 7
FIG. 8
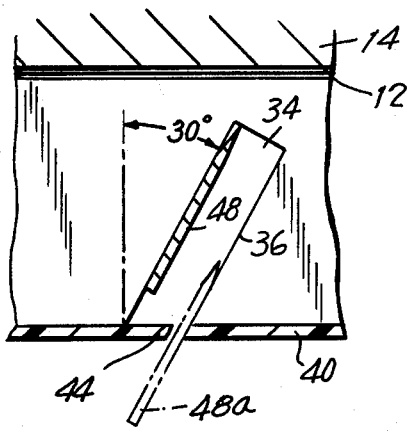
FIG. 9

IMPLEMENT RACK

BACKGROUND OF THE INVENTION

1. Field of the Invention

An implement rack.

2. Description of the Prior Art

In prior art, some implement racks have consisted of a bar with a plurality of horizontal slots into which the blade portions of knives would be inserted from above. These racks restricted the user's options as to the effective placement or location of the device, inasmuch as it required a surface with a minimum vertical dimension about two times the length of the longest knife to be held. The insertion and removal of the knives was inconvenient.

Other racks have avoided the aforesaid disadvantages by providing slots with open fronts to receive the knife blades, providing easy insertion and removal but creating a potentially dangerous disadvantage in that slight movement or vibration might cause the knives to fall.

Still other racks consisted of a horizontal member with a front surface of a permanently magnetic material capable of attracting and holding the blades of the knives. These racks, while providing easy attachment and removal, were potentially unsafe in that the contact of the blade to the magnet could be accidentally disturbed, causing immediate and total release.

SUMMARY OF THE INVENTION

1. Purposes of the Invention

It is an object of the present invention to provide an improved implement rack.

Another object is to provide an implement rack which is convenient and easy to use.

A further object is to provide an implement rack in which the implements cannot fall out of the rack due to movement, vibration or disturbing of the rack.

An additional object is to provide an implement rack in which the insertion and removal of the implement is very convenient.

Still another object is to provide an implement rack which eliminates the prior art disadvantages of location restrictions, insecure holding capability, and inconvenient removal of implements from the rack.

Still a further object is to provide an improved knife rack.

Still a further object is to provide an implement rack which equals the basic advantages of convenience found in the prior art while eliminating the accompanying disadvantages.

These and other objects and advantages of the present invention will become evident from the description which follows.

2. Brief Description of the Invention

In the present invention, the principal aspect of the invention is based on the fact that most knives or other implements, when supported by the blade end of the handle, will hang in a vertical position, blade or other elongated work member downward, i.e., the center of gravity of the knife or implement is located in the blade or the like.

In the rack of the instant invention, the position of the blade adjacent the handle, at rest, is contained within the limits of a space effectively shaped as a narrow wedge, with the top and narrowest point of the wedge of a size capable of accommodating the section of the blade. One side of the wedge shape originating at the top is in a vertical or near vertical first plane parallel to and adjacent to a flat surface of the knife blade. The opposite side of the wedge, also originating at the top, is at an angle to the first plane. The third and smallest side of the wedge is open. The knife, while within the confines of this wedge, is limited in movement to a vertical position by one side of the slot while allowed to pivot at an angle on the opposite side.

The intended access to this wedge is through a blade-thickness-wide front slot in a line extending from the angled plane of the wedge. Thus a knife may be inserted into the wedge from the front of the rack by tipping it with the blade at a position in line with the angled slot in the face of the holder and then entering the wedge. Upon release of the handle, gravity will immediately swing the knife toward the first plane.

The knife will remain captive within the wedge until it is realigned with the angled plane and withdrawn through the front slot. Although the knife may be lifted upwardly through the top slot, the inconvenience of this procedure renders it an unlikely method and in any case does not affect the security of the knives.

A knife so held will be effectively prevented from release caused by normal vibration or jarring incidental to common kitchen activity.

An added aspect incorporated in the invention, which improved upon the basic function, is the placement of the wedge in plan view at an angle to the front surface of the rack. This has the advantage of creating an acute angle with the front vertical surface of the rack which more effectively captures the hanging knife and, if the rack is transparent, more effectively displays the knife, providing easier recognition of its shape.

The stated principle of the invention may be applied in any plurality. Although the holding method is somewhat effective on any knife capable of fitting the slot, it is most effective when sized to fit the specifically intended knife blade, inasmuch as a loose fit will allow undesirable forward or backward movement or might permit unwanted release.

The principle is, in any case, not applicable to small knives, such as paring knives with handles heavier than the blade (a center of gravity in the handle rather than the blade). The product incorporating this invention includes another more conventional method of holding small knives; however the sizes of these knives does not cause the loss of space saving advantages created by the front entry method.

The present implement rack provides several salient advantages. The present implement rack completely and simply prevents implements from inadvertently becoming dislodged and falling out of the rack, due to slight movement, vibration or disturbing of the rack. Space is effectively conserved due to the front entry of the implements into the rack. The rack is simple and is readily and easily fabricated and manufactured, at low cost. The present rack controls the storage of the implements while permitting ready and easy retrieval of an implement from the rack for usage.

The invention accordingly consists in the features of construction, combination of elements and arrangement of parts which will be exemplified in the articles of manufacture hereinafter described and of which the scope of application will be indicated in the appended claims.

BRIEF DESCRIPTION OF THE DRAWINGS

In the accompanying drawings in which are shown various possible embodiments of the invention:

FIG. 6 is a sectional elevation view taken substantially along the line 6—6 of FIG. 1;

FIG. 7 shows a slot perpendicular to the front face of the rack;

FIG. 8 shows a slot inclined to the front face of the rack member; and

FIG. 9 shows a modified rack.

DETAILED DESCRIPTION OF THE PREFERRED EMBODIMENTS

Figure 1:
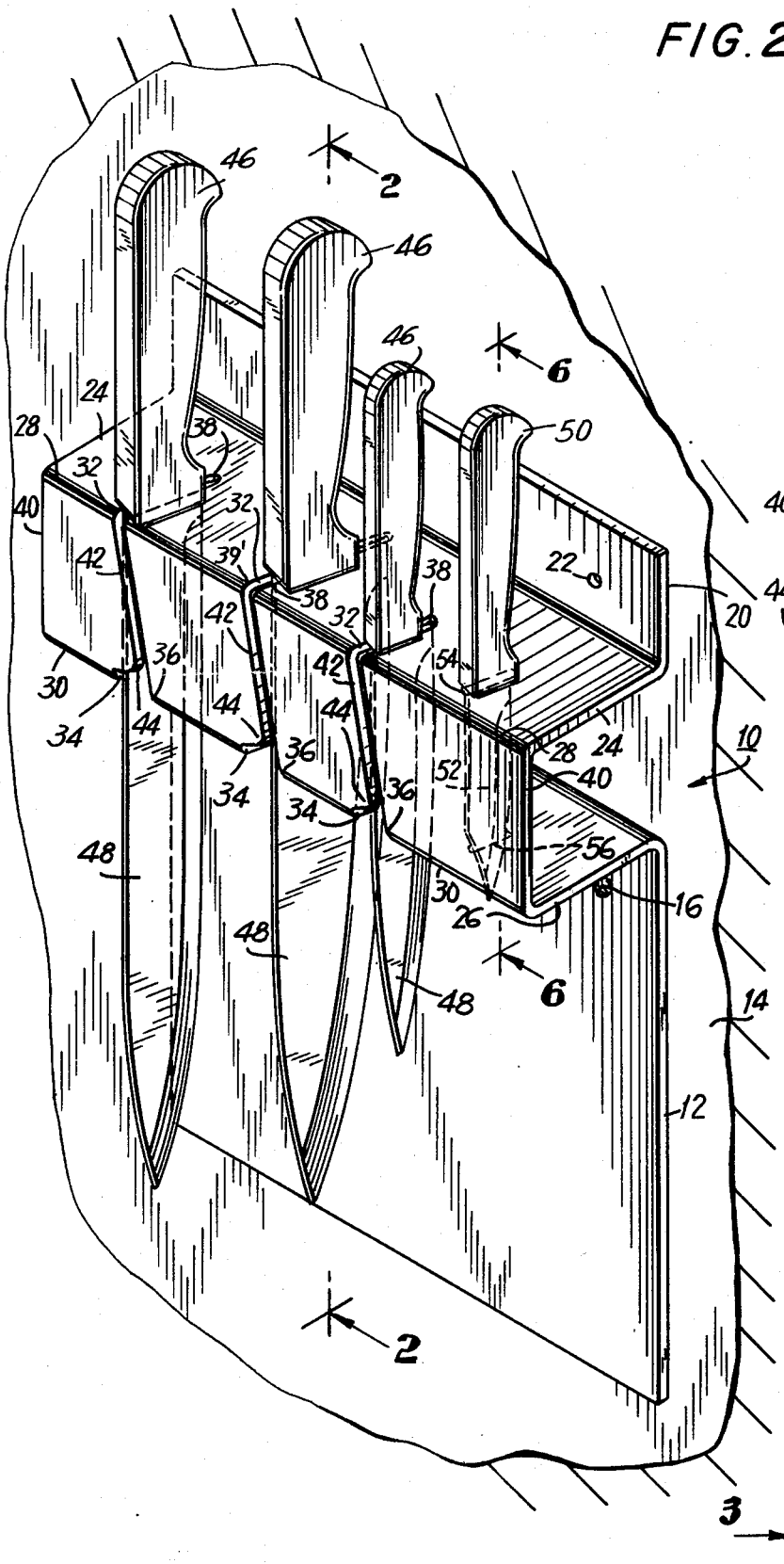
FIG. 1 is a perspective view of a preferred embodiment of the invention showing a plurality of knives mounted in the present implement rack.
Figure 2:
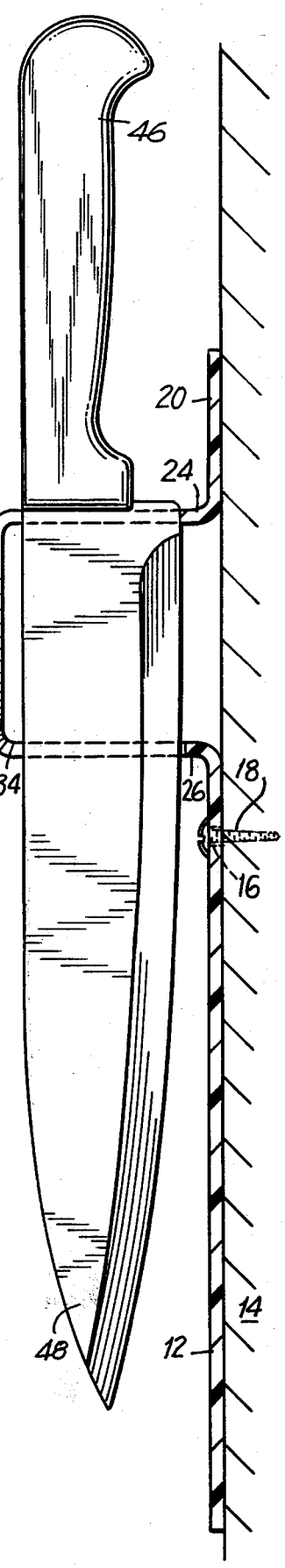
FIG. 2 is an enlarged sectional view taken substantially along the line 2—2 of FIG. 1.
Figure 3:
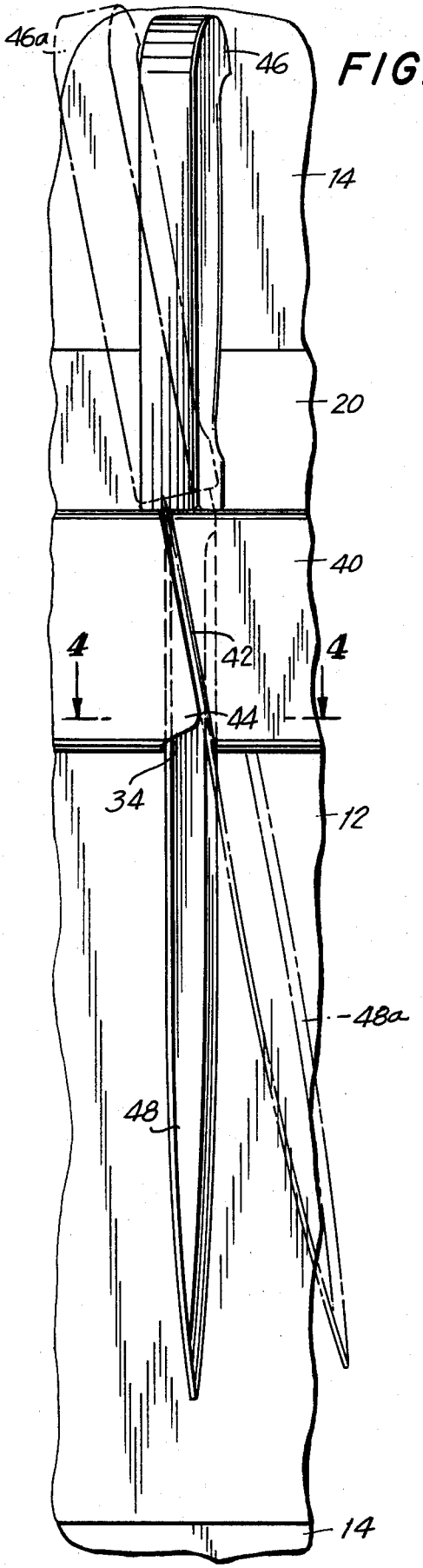
FIG. 3 is a front elevation view taken substantially along the line 3—3 of FIG. 2.

Referring now to FIGS. 1—6, a rack 10 embodying the present invention basically includes a lower vertical support panel 12 by means of which the rack is affixed to a vertical surface that typically is a vertical wall 14 of a kitchen or a kitchen cabinet. The support panel 12 conveniently is attached to the vertical surface 14 by screws 18 extending through holes 16 in the panel 12 into said surface 14 (FIG. 2). For support purposes there also may be provided an upper vertical support panel 20 having holes 22 comparable in function to the holes 16. The panels 12, 20 are coplanar.

The rack 10 is characterized in the broadest embodiment of the invention by the presence of an upper panel member 24 which is planar and generally horizontal, and a lower panel member 26 beneath the member 24 which is also planar and generally horizontal. The member 26 is vertically registered with the member 24. The member 24 has a front edge 28 and the member 26 has a front edge 30. Preferably, for the sake of appearance these edges are in vertical registry. At least one, and in the case of FIG. 1a plurality, of slots 32 are provided in the upper member 24. These slots run rearwardly from openings in the front edge 28 of the member 24. A corresponding plurality of slots 34 (see FIGS. 1-5) runs rearwardly in the member 26 from openings in the front edge 30 of said member.

The slots 32 and 34 in each case are substantially parallel in a vertical plane. However, one edge 36 (see FIGS. 4 and 5) of each slot 34 is laterally spaced from the vertical plane so that the edge 36 in each case is vertically disaligned from the corresponding edge 38 (see FIG. 5) of the upper slot 32. In each case, the opposite edge 39 (see FIGS. 1 and 5) of the slot 34 is less vertically disaligned from the corresponding opposite edge 39′ of the slot 32 and in the illustrated rack 10 these opposite edges are vertically aligned.

In this preferred embodiment, a vertical front panel member 40 connects the front edge 28 of the upper member 24 to the front edge 30 of the lower member 26. The front member 40 is provided with a plurality of top-to-bottom exit-entry slots 42 which are inclined from the vertical. Each slot 42 extends from the front end (mouth) of an upper slot 32 to the front end (mouth) of the lower slot 34. The widths of the top-to-bottom slots are about the same as those of the upper slots 32 so that tongues 44 are defined in the front member 40 by the slots 42 and the mouth of each of the slots 34. The tongues are of triangular configuration with a broad bottom and a narrow top. The purpose of the tongues 44 is to provide means blocking movement of the implements, in this case knives, each of which has a handle 46 and a blade 48, forwardly out of the slots when the knives are in their retained position as shown in FIG. 1 and in solid lines in FIGS. 3-5. As is evident from FIGS. 1, 2 and 4 the knives 46, 48 cannot be moved forwardly from the rack without previously tilting the blades to align their planes 48 with the exit-entry slots so that the blades 48 then can slide forwardly and horizontally out of the rack.

Figure 4:
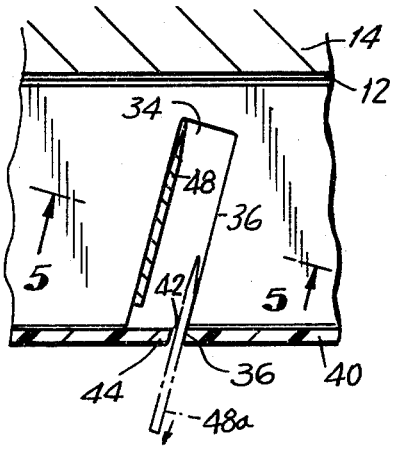
FIG. 4 is a fragmentary sectional plan view taken substantially along the line 4—4 of FIG. 3.
Figure 5:
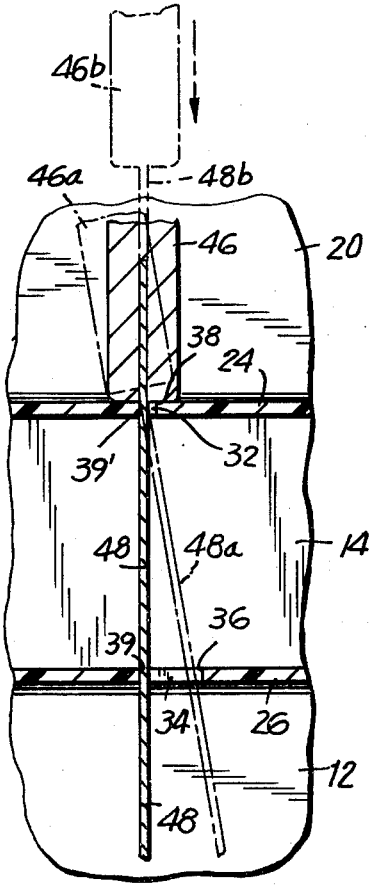
FIG. 5 is a fragmentary sectional elevation view taken substantially along the line 5—5 of FIG. 4.

Each knife 46, 48 is typical of implements to be held in the rack, i.e., implements constituting an elongated work member such as a knife blade, having a handle 46 at one end, and having its weight so distributed that the center of gravity of the implement is below the handle and in the blade 48. Because of this location of the center of gravity, and also since the top slots 32 are narrower than the handles 46; when knives 46, 48 are inserted horizontally through an exit-entry slot 42 fully into the rack and released, each knife 46, 48 being then in an inclined position will pivot toward an erect position about the junction between handle 46 and blade 48 where the handle rests on the upper member 24, so that the knife 46, 48 will swing to a retained position toward the edge 39 of lower slot 34 opposite to the edge 36, and the tongue 44 will block movement of the blade 48 or other such work member forwardly out of the associated exit-entry slot. Thus the knife 46, 48 tends to remain in its retained position and cannot be moved forwardly out of the support 12, 20 without previously manually aligning the blade 48 with the exit-entry slot 42 by tilting the knife 46, 48, at which time the blade 48 will again be aligned with such slot and can be manually moved forwardly. This tilted disposition of the knife 46, 48 is shown in phantom outline as 46*a*, 48*a* in FIGS. 3 and 5. FIG. 4 shows egress of the blade 48*a* from the slot 34, as well as the retained position of blade 48 in slot 34. Note in FIG. 4 that the tongue 44 blocks outward motion of the blade 48. FIG. 5 shows how the knife 46, 48 is retained against downwards motion because the handle 46 is wider than the upper slot 32, i.e., when initially inserted, the knife shown in phantom outline as 46*b*, 48*b* can move downwardly until handle 46 contacts the panel member 24.

FIGS. 1 and 4 illustrate a preferred embodiment of configuration of the slots 32 and 34, namely one in which the slots 32 and 34 run rearwardly at an acute angle of about15° from a perpendicular to the supports 20, 12. This acute angle may even approach an angle of about 30°, as shown in FIG. 8, or exceed the same. The reason for the preferred acute angle disposition of the slots 32 and 34 is to display the hanging blades from the front so that a user can select a desired knife with greater ease.

It will of course be appreciated by those skilled in the art that the slots 32 and 34 alternatively may be arranged perpendicularly to the support member 12, as shown in FIG. 7. It will be observed that the lower vertical support panel 12 limits back-and-forth tilting action of the knives which is also inhibited by the tendency of the knife handles to rest flatly on the upper surface of said panel, the lower ends of knives usually being perpendicular to the length of the knives. Moreover, the support member 12 (FIGS. 2 and 9) serves to protect the wall 14 from damage by the knife blades 48.

FIGS. 1 and 6 show an optional additional structure which may be provided to accommodate for implements such as a small paring knife having a handle 50 which is heavier than its blade 52 so that the center of gravity of the knife is in the handle 50. For such implements a closed-ended slot 54 is provided in the upper panel member 24, and an opposite closed-ended slot 56 aligned vertically below the slot 54 is provided in the lower panel member 26, so that the knife 50, 52 may be inserted into the rack vertically downwards from above, rather than horizontally as with the knives 46, 48. The knife 50, 52 is retained in place simply because the tip of blade 52 in the slot 56 prevents the knife 50, 52 from pivoting sufficiently to fall out of the rack.

FIG. 9 illustrates another embodiment of the invention in which a lower generally horizontal panel member 58 extends forwardly from the lower edge of the support member 12 below the tip of the blade 48. This member 58 protects the blade tips from damage and also protects people from harm.

The members 12, 20, 24 and 26 (and 58 if present), are thermoformed from a single sheet of a plastic material such as an acrylic resin, nylon, cellulose acetate, cellulose acetate butyrate, polyethylene or polypropylene; and panel members 24 and 26 preferably are transparent so that the knives or other implements are effectively displayed in front view, providing easier recognition of their shape.

It thus will be seen that there are provided implement racks which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. A rack for supporting an implement constituting an elongated work member having a handle at one end and having its weight so distributed that the center of gravity of the implement is below the handle, said rack comprising a. a support, b. an upper member having a front edge, c. a lower member beneath the upper member and having a front edge, d. means providing a slot in the upper member running rearwardly from an opening in the front edge of said upper member, e. means providing a slot in the lower member running rearwardly from an opening in the front edge of said lower member, f. said slots being substantially parallel in a vertical plane with one edge of the slot of (e) laterally spaced from said vertical plane, so that said one edge of the lower slot is vertically disaligned from the corresponding edge of the upper slot, g. said top slot being narrower than the corresponding dimension of said handle when the implement is in said support, h. means permitting moving of the work member rearwardly from the front of the rack and into the slots and toward said support to a retained position, said means permitting moving of the work member rearwardly being vertically disaligned with a vertical plane, i. the opposite edge of the lower slot being less vertically disaligned from the corresponding edge of the upper slot whereby when an implement is introduced into said slots from the front of the rack by the means of (h) and released, the implement will pivot about the junction between the handle and the work member, so that the implement will swing to a retained position toward the opposite edge of the lower slot, and j. means blocking moving of the work member forwardly out of the slots when the implement is in its retained position whereby the implement cannot be moved forwardly from the support without previously aligning the work member with the first named set of edges of the two slots.

2. The implement rack of claim 1 in which a front member connects the upper member and the lower member, said front member having means providing a slot, said slot being inclined from the vertical and extending between the upper slot and the one edge of the lower slot, so that a tongue is defined in said front member by said slot in said front member and the front edge of the lower slot.

3. The implement rack of claim 1 in which the implement is a knife.

4. The implement rack of claim 1 in which the base and the frame are composed of a plastic selected from the group consisting of an acrylic resin, cellulose acetate, cellulose acetate butyrate, nylon, polyethylene and polypropylene.

5. The implement rack of claim 1 in which the upper member and the lower member are transparent.

6. The implement rack of claim 1 in which the slots in the upper and lower members run rearwardly at an acute angle from perpendicular to the support.

7. The implement rack of claim 1 in which the slots in the upper and lower members run rearwardly perpendicular to the support.

8. The implement rack of claim 1 in which the support includes a lower panel to limit front-to-back tilting of the implement.

9. The implement rack of claim 8 in which a panel depends from the lower panel, said dependent panel being substantially perpendicular to the lower panel.

10. A rack for supporting an implement constituting an elongated work member having a handle at one end and having its weight so distributed that the center of gravity of the implement is below the handle, said rack comprising a. a support, b. an upper member having a front edge, c. a lower member beneath the upper member and having a front edge, d. means providing a slot in the upper member running rearwardly from an opening in the front edge of said upper member, e. means providing a slot in the lower member running rearwardly from an opening in the front edge of said lower member, f. said slots being substantially parallel in a vertical plane with one edge of the slot of (e) laterally spaced from said vertical plane, so that said one edge of the lower slot is vertically disaligned from the corresponding edge of the upper slot, g. said top slot being narrower than the corresponding dimension of said handle when the implement is in said support, h. the opposite edge of the lower slot being less vertically disaligned from the corresponding edge of the upper slot whereby when an implement is introduced into said slots from the front of the rack and released, the implement will pivot about the junction between the handle and the work member, so that the implement will swing to a retained position toward the opposite edge of the lower slot, and i. a front member, said front member connecting said upper member and said lower member, said front member having means providing a slot, said slot being inclined from the vertical and extending between said upper slot and the one edge of said lower slot, so that a tongue is defined in said front member by said slot in said front member and the front edge of said lower slot, said tongue blocking moving of the work member forwardly out of said upper and lower slots when the implement is in its retained position whereby the implement cannot be moved forwardly from the support without previously aligning the work member with the first named set of edges of the upper and lower slots.

* * * * *